US009195164B2

(12) United States Patent
Wakamatsu et al.

(10) Patent No.: US 9,195,164 B2
(45) Date of Patent: Nov. 24, 2015

(54) IMAGE FORMING APPARATUS

(71) Applicant: Brother Kogyo Kabushiki Kaisha, Nagoya-shi, Aichi-ken (JP)

(72) Inventors: Mayu Wakamatsu, Tsushima (JP); Masatoshi Shiraki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/526,586

(22) Filed: Oct. 29, 2014

(65) Prior Publication Data

US 2015/0117883 A1 Apr. 30, 2015

(30) Foreign Application Priority Data

Oct. 29, 2013 (JP) ..... 2013-224042

(51) Int. Cl.
*G03G 15/06* (2006.01)
*G03G 21/00* (2006.01)

(52) U.S. Cl.
CPC ..... *G03G 15/065* (2013.01); *G03G 21/0058* (2013.01)

(58) Field of Classification Search
USPC ..... 399/44
See application file for complete search history.

(56) References Cited

U.S. PATENT DOCUMENTS

| | | | | |
|---|---|---|---|---|
| 7,756,461 | B2 * | 7/2010 | Sato et al. | 399/349 |
| 2007/0020005 | A1 * | 1/2007 | Shigezaki et al. | 399/349 |
| 2009/0052929 | A1 * | 2/2009 | Tomoe | 399/71 |
| 2011/0085834 | A1 * | 4/2011 | Naruse et al. | 399/350 |
| 2012/0189330 | A1 * | 7/2012 | Kunimatsu et al. | 399/44 |
| 2013/0108289 | A1 * | 5/2013 | Tamura | 399/43 |

FOREIGN PATENT DOCUMENTS

JP 2003280334 A 10/2003

* cited by examiner

*Primary Examiner* — Clayton E Laballe
*Assistant Examiner* — Linda B Smith
(74) *Attorney, Agent, or Firm* — Banner & Witcoff, Ltd.

(57) ABSTRACT

An image forming apparatus includes an image carrier which carries thereon a developer image, a holding roller which holds thereon developer attached on the image carrier, a collection device which collects the developer on the holding roller via at least the image carrier, and a control device which executes a holding control of applying to the holding roller a holding bias having a polarity opposite to the developer such that the holding roller holds developer and a collection control of applying to the holding roller a discharge bias having a polarity same as the developer such that the developer held on the holding roller is moved to the image carrier and the collection device collects the developer via the image carrier. The control device starts the collection control at a timing after a predetermined point of time according to an estimated charge amount of the developer.

20 Claims, 6 Drawing Sheets

IMAGE FORMING APPARATUS

CROSS-REFERENCE TO RELATED APPLICATION

This application claims priority from Japanese Patent Application No. 2013-224042, filed on Oct. 29, 2013, the entire subject matter of which is incorporated herein by reference.

TECHNICAL FIELD

Aspects of the present invention relate to an image forming apparatus configured to execute a collection control for collecting developer on a holding roller via at least an image carrier into a collection device.

BACKGROUND

There has been known an image forming apparatus which includes a photosensitive drum configured to form an electrostatic latent image thereon, a charging roller configured to contact the photosensitive drum and charge the photosensitive drum, and a developing device configured to supply toner to an electrostatic latent image on the photosensitive drum to form a toner image on the photosensitive drum (refer to JP-A-2003-280334). In this image forming apparatus, when toner attached on the charging roller reaches a predetermined amount, a collection control of discharging the toner on the charging roller to the photosensitive drum and collecting the toner into the developing device via the photosensitive drum is executed.

However, in this information forming apparatus, the collection control is not performed as long as the amount of the toner attached on the charging roller is less than the predetermined amount. Therefore, the toner may be held on the charging roller for a long time. In this case, since the charge amount of the toner on the charging roller is gradually decreased and a holding force of the toner by the charging roller is gradually lowered, the toner may be detached from the charging roller and the detached toner may cause a printing defect.

SUMMARY

Accordingly, it is an aspect of the present invention to suppress developer from being detached from a holding roller such as a charging roller, thereby suppressing a printing defect due to detached developer.

According to an illustrative embodiment of the present invention, there is provided an image forming apparatus including an image carrier configured to carry thereon a developer image, a holding roller provided to contact the image carrier and configured to hold thereon developer attached on the image carrier, a collection device configured to collect the developer on the holding roller via at least the image carrier, and a control device configured to execute a holding control of applying to the holding roller a holding bias having a polarity opposite to the developer such that the holding roller holds developer, a collection control of applying to the holding roller a discharge bias having a polarity same as the developer such that the developer held on the holding roller is moved to the image carrier and the collection device collects the developer via at least the image carrier, and a printing control of transferring a developer image on the image carrier to a sheet. The control device is further configured to estimate a charge amount of the developer on the holding roller; when the estimated charge amount is larger than a predetermined value, start the collection control at a first timing after a first time elapses from a predetermined point of time; and when the estimated charge amount is equal to or smaller than the predetermined value, start the collection control at a second timing after a second time elapses from the predetermined point of time, the second time being shorter than the first time.

According to another illustrative embodiment of the present invention, there is provided an image forming apparatus including an image carrier configured to carry thereon a developer image, a holding roller provided to contact the image carrier and configured to hold thereon developer attached on the image carrier, a collection device configured to collect the developer on the holding roller via at least the image carrier, and a control device configured to execute a holding control of applying to the holding roller a holding bias having a polarity opposite to the developer such that the holding roller holds developer, and a collection control of applying to the holding roller a discharge bias having a polarity same as the developer such that the developer held on the holding roller is moved to the image carrier and the collection device collects the developer via at least the image carrier. The control device is further configured to: when a humidity is less than a first threshold value, start the collection control at a first timing after a first time elapses from a predetermined point of time; and when the humidity is equal to or larger than the first threshold value, start the collection control at a second timing after a second time elapses from the predetermined point of time, the second time being shorter than the first time.

According to a further illustrative embodiment of the present invention, there is provided an image forming apparatus including an image carrier configured to carry thereon a developer image, a developing device configured to accommodate therein developer, a holding roller provided to contact the image carrier and configured to hold thereon developer attached on the image carrier, a collection device configured to collect the developer on the holding roller via at least the image carrier, and a control device configured to execute a holding control of applying to the holding roller a holding bias having a polarity opposite to the developer such that the holding roller holds developer, and a collection control of applying to the holding roller a discharge bias having a polarity same as the developer such that the developer held on the holding roller is moved to the image carrier and the collection device collects the developer via at least the image carrier. The control device is further configured to: when a total number of printed sheets of the developing device is less than a fourth threshold value, start the collection control at a first timing after a first time elapses from a predetermined point of time; and when the total number of printed sheets of the developing device is equal to or larger than the fourth threshold value, start the collection control at a second timing after a second time elapses from the predetermined point of time, the second time being shorter than the first time.

According to the present invention, since it is possible to suppress the developer from being detached from the holding roller, it is possible to suppress the printing defect due to detached developer.

BRIEF DESCRIPTION OF THE DRAWINGS

The above and other aspects of the present invention will become more apparent and more readily appreciated from the following description of illustrative embodiments of the present invention taken in conjunction with the attached drawings.

DETAILED DESCRIPTION

Hereinafter, an illustrative embodiment of the present invention will be described in detail with reference to the drawings. In the below descriptions, the directions are described on the basis of a user who uses a color printer (an example of an image forming apparatus). That is, the left of FIG. 1 is referred to as the 'front side,' the right of FIG. 1 is referred to as the 'rear side,' the back side of FIG. 1 is referred to as the left side' and the front side of FIG. 1 is referred to as the 'right side.' Also, the upper and lower directions of FIG. 1 are referred to as the 'upper-lower direction.'

Figure 1:
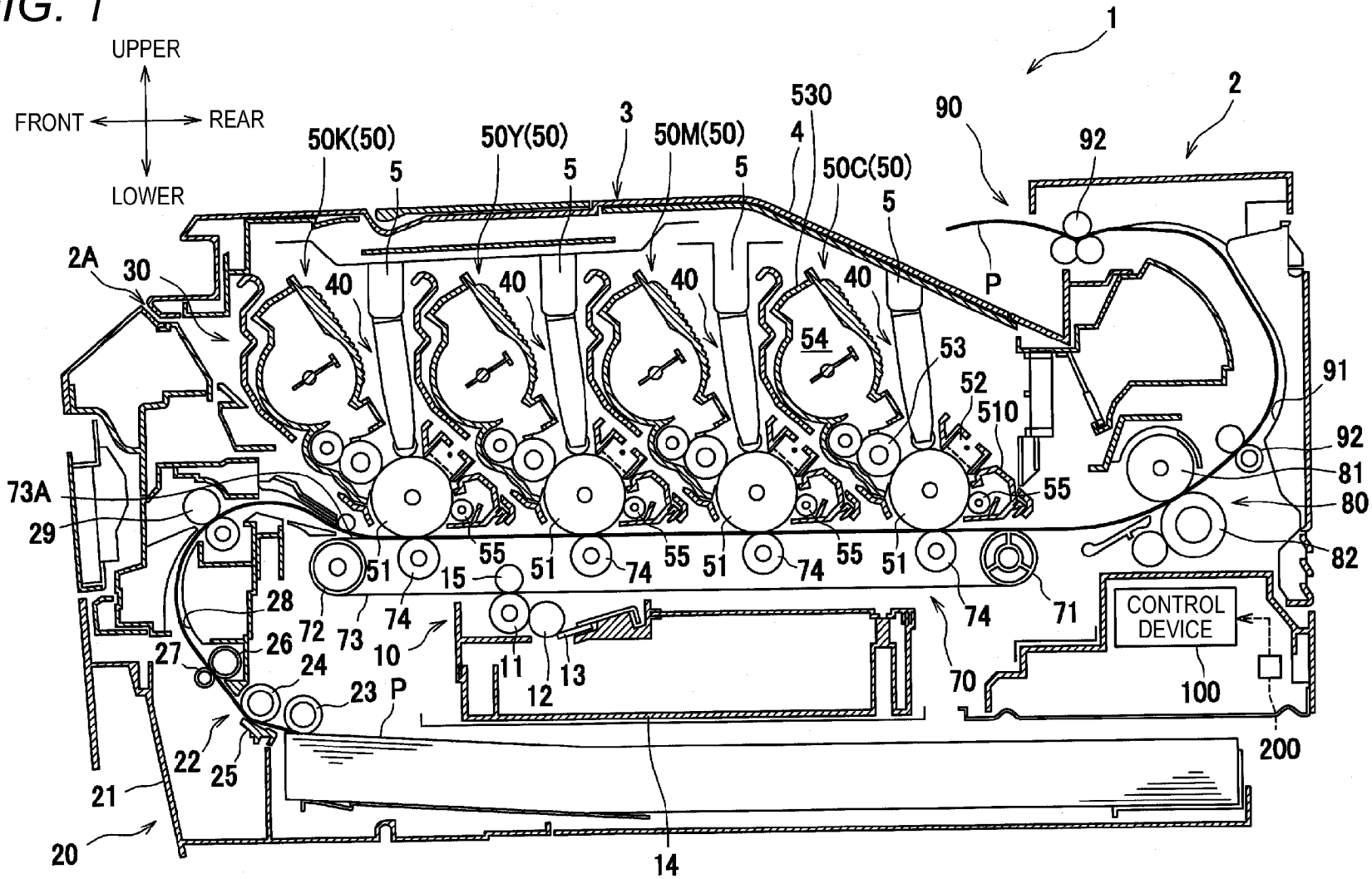
FIG. 1 is a sectional view showing a color printer according to an illustrative embodiment of the present invention.

As shown in FIG. 1, a color printer 1 has, in an apparatus main body 2, a feeder unit 20 configured to feed a sheet P (an example of a sheet), an image forming unit 30 configured to form an image on the fed sheet P, a sheet discharge unit 90 configured to discharge the sheet P having an image formed thereon, and a control device 100.

The apparatus main body 2 is formed at its upper part with an opening 2A. The opening 2A is opened and closed by an upper cover 3 rotatably supported to the apparatus main body 2. An upper surface of the upper cover 3 is a sheet discharge tray 4 on which the sheet P discharged from the apparatus main body 2 is accumulated, and a lower surface thereof is provided with a plurality of LED attaching members 5 configured to hold LED units 40.

The feeder unit 20 is provided at a lower part in the apparatus main body 2 and includes a sheet feeding tray 21 detachably mounted to the apparatus main body 2 and a sheet feeding mechanism 22 configured to convey the sheet P from the sheet feeding tray 21 towards the image forming unit 30. The sheet feeding mechanism 22 is provided in front of the sheet feeding tray 21 and includes a sheet feeding roller 23, a separation roller 24, a separation pad 25, a sheet dust collection roller 26, a pinch roller 27 and a registration roller 29.

In the feeder unit 20, the sheets P fed from the sheet feeding tray 21 by the sheet feeding roller 23 are separated by the separation roller 24 and the separation pad 25 one by one, which is then conveyed to the upper, and the sheet dusts are removed while the sheet passes between the sheet dust collection roller 26 and the pinch roller 27. After that, the direction of the sheet P is changed through a conveyance path 28 to direct rearward, the skew of the sheet P is corrected by the registration rollers 29, and then, the sheet P is fed to the image forming unit 30.

The image forming unit 30 has four LED units 40, four process cartridges 50, a transfer unit 70, a cleaning device 10 (an example of a collection device), and a fixing device 80.

The LED unit 40 is swingably coupled to the LED attaching member 5 and is appropriately positioned and supported by a positioning member provided for the apparatus main body 2.

The process cartridges 50 are arranged side by side in the front-rear direction between the upper cover 3 and the feeder unit 20, and have a drum cartridge 510 and a developing cartridge 530 (an example of a developing device), respectively. The drum cartridge 510 has a photosensitive drum 51 (an example of an image carrier), a charger 52 and a cleaning roller 55 (an example of a holding roller). The developing cartridge 530 is detachably mounted to the drum cartridge 510 and has a developing roller 53 and a toner accommodation chamber 54 configured to accommodate therein toner (an example of developer).

The process cartridges 50 are arranged side by side from an upstream side of a conveyance direction (a moving direction of a belt surface) of the sheet P in order of the process cartridges 50K, 50Y, 50M, 50C in which black, yellow, magenta and cyan toners are respectively accommodated. Meanwhile, in the specification and drawings, when specifying the photosensitive drum 51, the developing roller 53, the cleaning roller 55 and the like corresponding to the color of the toner, the reference signs K, Y, M, C are respectively attached in correspondence to black, yellow, magenta and cyan.

The photosensitive drums 51 are respectively provided for the plurality of drum cartridges 510 and are arranged side by side in the front-rear direction.

The developing roller 53 is configured to contact the photosensitive drum 51 and to supply the toner to an electrostatic latent image on the photosensitive drum 51. Incidentally, in this illustrative embodiment, when supplying the toner from the developing roller 53 to the photosensitive drum 51, the toner is sliding-contacted between the developing roller 53 and a supply roller (a reference numeral thereof is omitted), so that the toner is positively charged.

Figure 2:
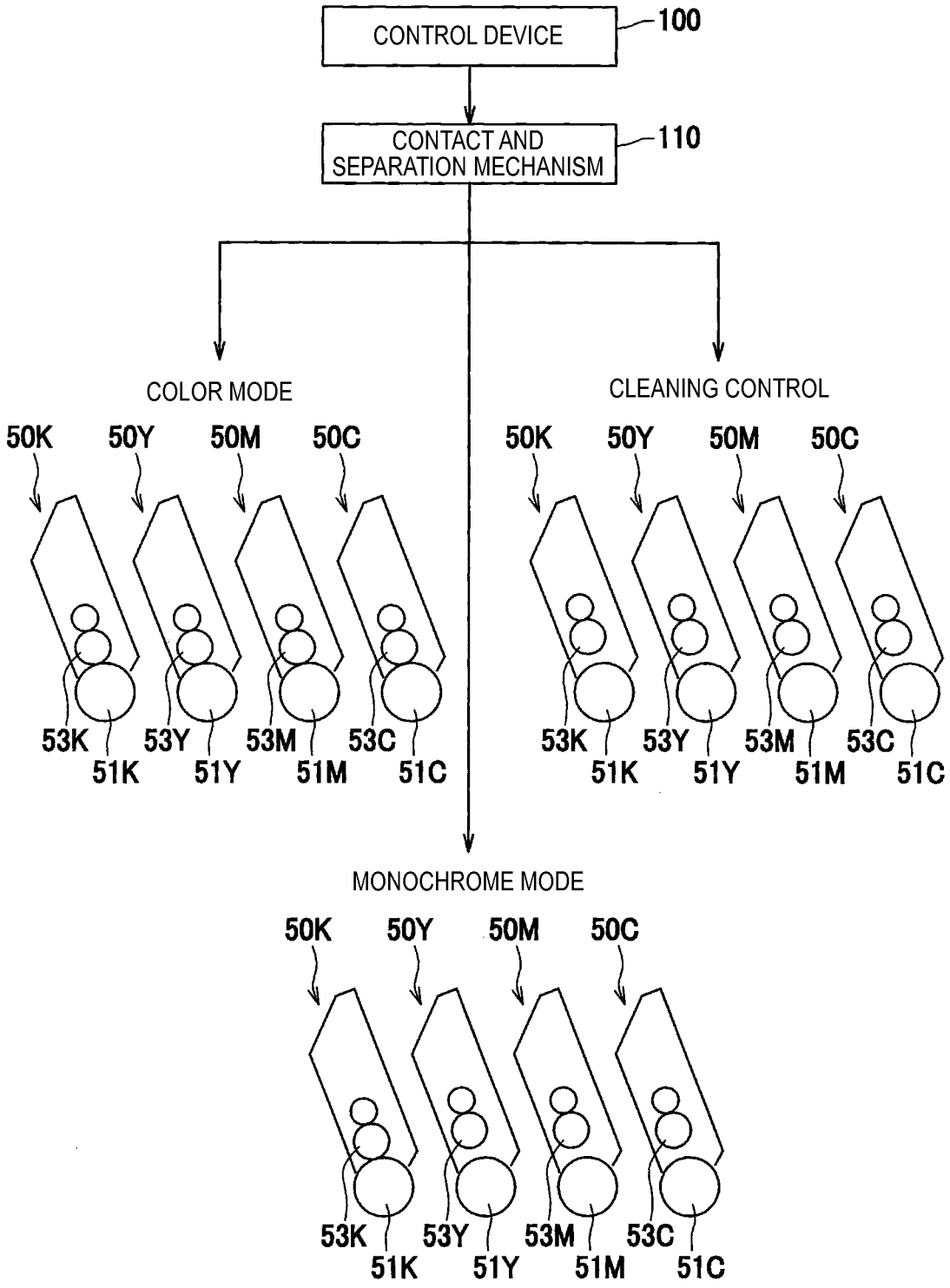
FIG. 2 shows separation states between photosensitive drums and developing rollers.

As shown in FIG. 2, the developing roller 53 is caused to come close to and to separate from the photosensitive drum 51 by controlling a contact and separation mechanism 110 with the control device 100. Specifically, in a color mode, all the developing rollers 53K, 53Y, 53M, 53C are contacted to the corresponding photosensitive drums 51K, 51Y, 51M, 51C to supply the toners to the respective photosensitive drums 51K, 51Y, 51M, 51C. In a monochrome mode, only the developing roller 53K for black (for monochrome) is contacted to the photosensitive drum 51K, and the other developing rollers 53Y, 53M, 53C are separated from the corresponding photosensitive drums 51Y, 51M, 51C. Further, in a collection control (cleaning control) which will be described later, all the developing rollers 53K, 53Y, 53M, 53C are separated from the corresponding photosensitive drums 51K, 51Y, 51M, 51C.

As shown in FIG. 1, the plurality of cleaning rollers 55 are provided in the vicinity of the respective photosensitive drums 51 so as to correspond to the respective photosensitive drums 51. The cleaning roller 55 is configured so that a holding bias having an opposite polarity to the toner is applied thereto and the toner attached on the photosensitive drum 51 can be thus temporarily held with the cleaning roller 55. Also, the cleaning roller 55 is configured so that a discharge bias having the same polarity as the toner is applied thereto and the toner held by the cleaning roller 55 can be thus discharged (moved) to the photosensitive drum 51.

The transfer unit 70 is provided between the feeder unit 20 and the respective process cartridges 50, and has a driving roller 71, a driven roller 72, a conveyance belt 73 and transfer rollers 74.

The driving roller 71 and the driven roller 72 are arranged in parallel with being spaced from each other in the front-rear direction, and the conveyance belt 73 configured by an endless belt is wound around the driving roller 71 and the driven roller 72. The conveyance belt 73 has, as an outer surface, a belt surface 73A (facing surface) configured to face and contact the respective photosensitive drums 51, and is configured to rotate by the driving roller 71 so that the belt surface 73A moves along the arrangement direction of the respective photosensitive drums 51. Also, the four transfer rollers 74 configured to interpose the conveyance belt 73 between the respective photosensitive drums 51 and the transfer rollers 74 are arranged to face the respective photosensitive drums 51 at an inner side of the conveyance belt 73. A transfer bias is applied to the transfer rollers 74 at the transfer by a constant current control.

The cleaning device 10 is configured to sliding-contact the conveyance belt 73 and to collect the toner and the like attached on the conveyance belt 73 and is arranged to face the conveyance belt 73 at the lower of the conveyance belt 73. Specifically, the cleaning device 10 is configured to collect the toner on the cleaning rollers 55 via the photosensitive drums 51 and the conveyance belt 73. Specifically, the cleaning device 10 has a sliding-contact roller 11, a collection roller 12, a blade 13 and a waste toner chamber 14.

The sliding-contact roller 11 is arranged to contact an outer periphery of the conveyance belt 73 and is configured to collect the attachments on the conveyance belt 73 while a collection bias is applied between the sliding-contact roller 11 and a backup roller 15 arranged on an inner periphery of the conveyance belt 73.

The collection roller 12 is configured to sliding-contact the sliding-contact roller 11, and is configured to collect the attachments attached on the sliding-contact roller 11. The attachments on the collection roller 12 are scraped by the blade 13 arranged to sliding-contact the collection roller 12 and are collected into the waste toner chamber 14.

The fixing unit 80 is arranged at the rear side of the respective process cartridges 50 and the transfer unit 70, and has a heating roller 81 and a pressing roller 82 arranged to face the heating roller 81 and configured to press the heating roller 81.

In the image forming unit 30 configured as described above, the surface of each photosensitive drum 51 is uniformly positively charged by the charger 52 and is then exposed by each LED unit 40, in the color mode. Thereby, a potential of the exposed part are lowered, so that an electrostatic latent image based on image data is formed on each photosensitive drum 51. After that, the positively-charged toner is supplied to the electrostatic latent image from the developing roller 53, so that a toner image is carried on the photosensitive drum 51.

Then, the sheet P fed onto the conveyance belt 73 passes between the respective photosensitive drums 51 and the respective transfer rollers 74 arranged at the inner side of the conveyance belt 73, so that the toner images formed on the respective photosensitive drums 51 are transferred onto the sheet P. Then, the sheet P passes between the heating roller 81 and the pressing roller 82, so that the toner images transferred on the sheet P are heat-fixed.

The sheet discharge unit 90 has a sheet discharge conveyance path 91 extending upwardly from an exit of the fixing device 80 and formed to reverse forwards, and a plurality of pairs of conveyance rollers 92 configured to convey the sheet P. The sheet P having the toner images transferred and heat-fixed thereon is conveyed along the sheet discharge conveyance path 91 and is discharged to the outside of the apparatus main body 10 by the conveyance rollers 92, so that the sheet is accumulated on the sheet discharge tray 4.

In the below, the control device 100 is described in detail.

The control device 100 has a CPU (Central Processing Unit), a ROM (Read Only Memory), a RAM (Random Access Memory) and the like, and is configured to receive a printing command and to control the feeder unit 20, the image forming unit 30, the sheet discharge unit 90 and the contact and separation mechanism 110 based on a program stored in advance. In the meantime, the apparatus main body 2 is provided with a humidity detector 200 (an example of a humidity detection unit) configured to detect humidity, and the humidity detected by the humidity detector 200 is output to the control device 100.

Specifically, the control device 100 is configured to execute a holding control of applying a negative holding bias to the cleaning rollers 55 such that the cleaning rollers 55 hold the toners thereon, a collection control of applying a positive discharge bias to the cleaning rollers 55 such that the developer held on the cleaning rollers 55 is moved to the photosensitive drums 51 and cleaning device 10 collects developer via the photosensitive drums 51 and the conveyance belt 73, and a printing control of transferring the toner images on the photosensitive drums 51 to the sheet P.

The control device 100 has a charge amount estimation unit configured to estimate a charge amount of the toner on the cleaning roller 55, and is configured to change a timing at which the collection control starts according to the charge amount of the toner on the cleaning roller 55 estimated by the charge amount estimation unit. Specifically, in this illustrative embodiment, the charge amount estimation unit is configured to estimate that the charge amount is larger than a predetermined value when the humidity detected by the humidity detector 200 is less than a first threshold value, and to estimate that the charge amount is equal to or smaller than the predetermined value when the humidity detected by the humidity detector 200 is equal to or larger than the first threshold value. Specifically, the control device 100 is configured to execute the control in accordance with flowcharts shown in FIGS. 3 to 5.

Figure 3:
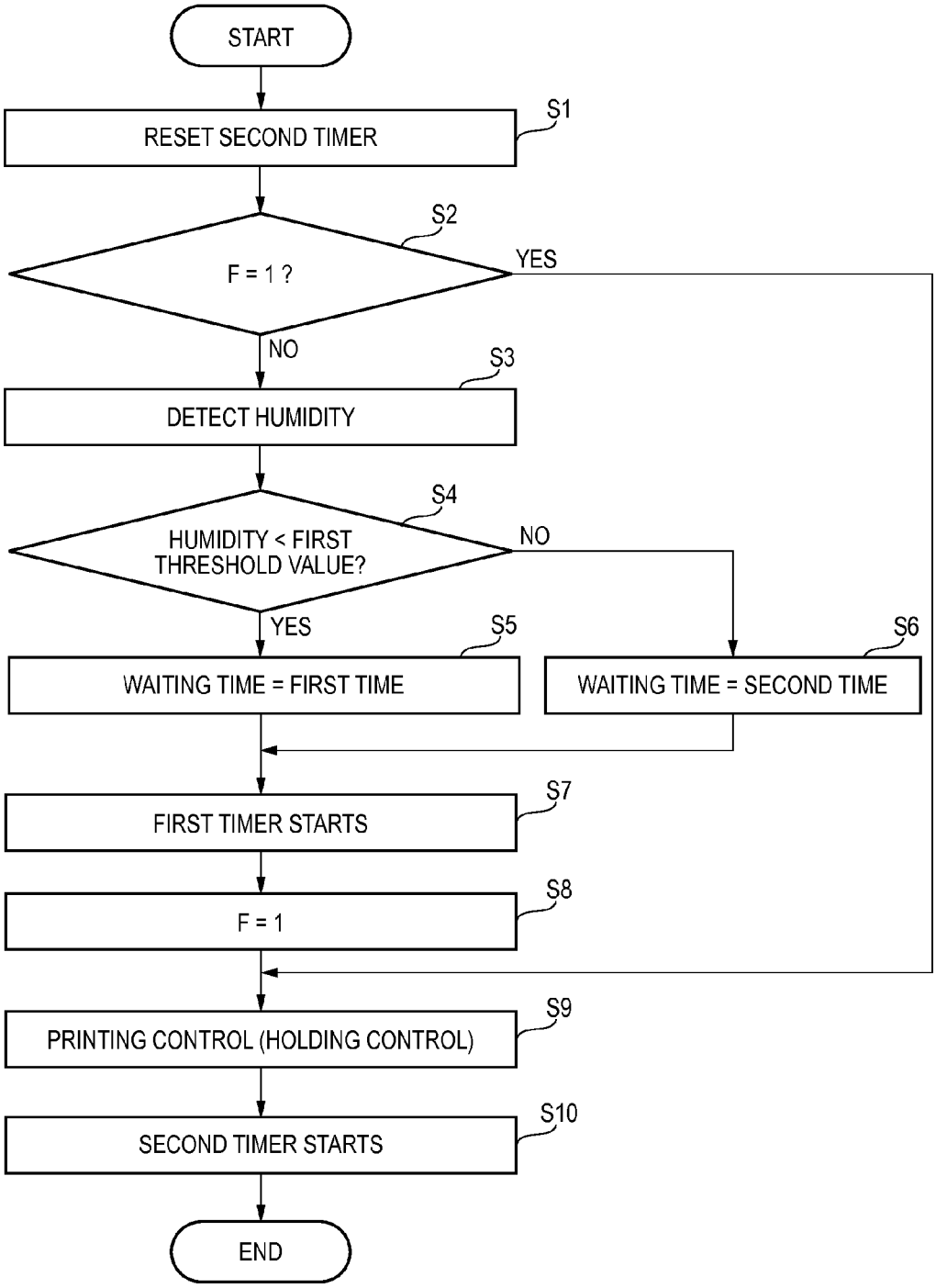
FIG. 3 is a flowchart showing an operation of a control device which is performed when a printing command is received.

When a printing command is received, the control device 100 starts the control shown in FIG. 3 (START). Incidentally, the control device 100 is configured to repeatedly execute the controls shown in FIGS. 4 and 5 all the time.

In the control of FIG. 3, the control device 100 first resets a second timer (S1). Specifically, the control device 100 returns a numerical value of the second timer having started to measure time in step S10 (described later) to 0 and keeps the numerical value of the second time at 0 in step S1.

After step S1, the control device 100 determines whether a flag F is 1 (S2). Here, the flag F indicates whether a first timer (described later) is measuring time. When the flag F is 1, this indicates that the first time is measuring time, and when the flag F is 0, this indicates that the first time is not measuring time.

When it is determined in step S2 that the flag F is not 1 (No), the control device 100 receives the humidity from the humidity detector 200 (S3). After step S3, the control device 100 determines whether the humidity is less than the first threshold value (S4).

When it is determined in step S4 that the humidity is less than the first threshold value (Yes), the control device 100 sets a waiting time until the collection control is performed to a first time (S5), and when it is determined that the humidity is equal to or larger than the first threshold value (No), the control device 100 sets the waiting time to a second time shorter than the first time (S6). Here, when the humidity is less than the first threshold value, i.e., when there is an environment of low humidity, the charge amount of the toner held by the cleaning roller 55 becomes larger than the predetermined value in the holding control (described later), and when the humidity is equal to or larger than the first threshold value, i.e., when there is an environment of high humidity, the charge amount of the toner held by the cleaning roller 55 becomes equal to or smaller than the predetermined value.

Therefore, in step S4, the control device 100, in fact, determines whether the charge amount of the toner estimated by the charge amount estimation unit is larger than the predetermined value. Incidentally, the first threshold value, the first time and the second time (described above) and respective times and threshold values (described later) can be appropriately set by a test, a simulation and the like.

After step S5 or S6, the control device 100 starts to measure time by the first timer (S7). That is, the control device 100 is configured to start the time measuring by the first timer from a point of time before the printing control starts.

After step S7, the control device 100 sets the flag F to 1 (S8). After step S8 or when a result of the determination in step S2 is Yes, the control device 100 executes the printing control and the holding control (S9).

Specifically, the control device 100 is configured to execute a control of light-emission of the respective LED units 40 based on image data of the printing command, a control on the bias to be applied to the respective photosensitive drums 51 and the respective transfer rollers 74, a control of supplying current to the heating roller 81 of the fixing device 80, a rotation control on the various rollers and conveyance belt 73 for conveying the sheet P, and the like.

Also, the control device 100 is configured to execute the holding control of applying the negative holding bias to the cleaning rollers 55 to collect and hold the toners (hereinafter, referred to as 'transfer remaining toners') remaining on the photosensitive drums 51 without being transferred to the sheet P from the photosensitive drums 51 by the cleaning rollers 55, under the printing control. Specifically, the control device 100 is configured to apply the holding bias to all the cleaning rollers 55 during the printing control, irrespective of the mode (monochrome or color mode) of the printing control.

Incidentally, the control device 100 may be configured not to apply the holding bias to the three cleaning rollers 55 except for the cleaning roller 55 for black when the printing control is the monochrome mode. In this case, the control device 100 may be also configured not to apply the discharge bias to the three cleaning rollers 55 except for the cleaning roller 55 for black, in the collection control, too.

When the printing control is finished, i.e., when the printing of all the sheets P in accordance with the printing command is finished, the control device 100 starts to measure time by the second timer (S10) and finishes this control.

Figure 4:
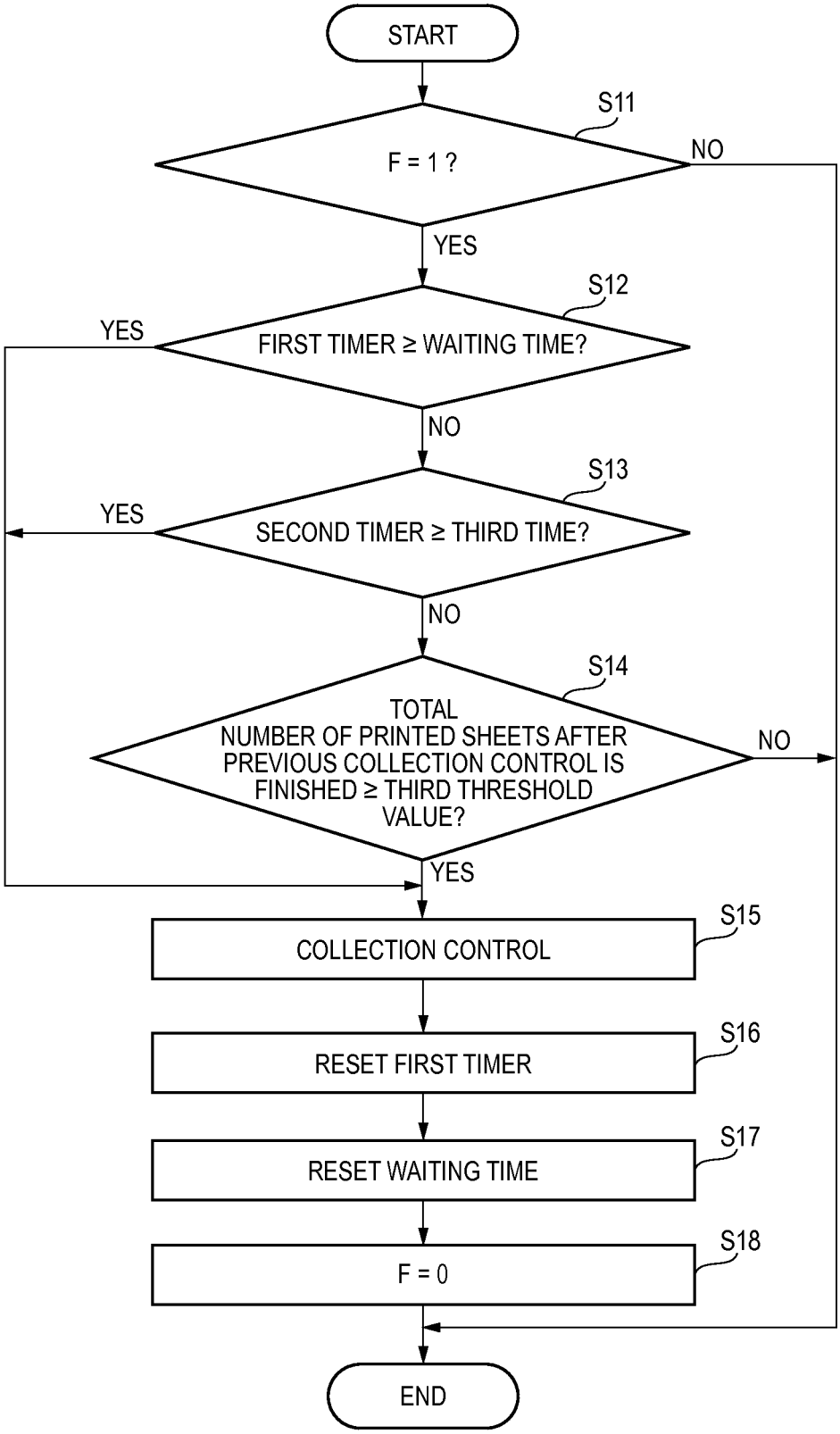
FIG. 4 is a flowchart showing an operation of the control device for executing a collection control.

In the control of FIG. 4, the control device 100 first determines whether the flag F is 1 (S11). When the flag F is not 1 (No), the control device 100 finishes this control. When it is determined in step S11 that the flag F is 1 (Yes), the control device 100 determines whether the first timer becomes equal to or longer than the waiting time (the first time or second time) set in step S5 or S6 (S12).

When it is determined in step S12 that the first timer becomes equal to or longer than the waiting time (Yes), the control device 100 executes the collection control (S15). That is, when the humidity is below the first threshold value at the setting of the waiting time (when the charge amount of the toner on the cleaning roller 55 is larger than the predetermined value), the collection control starts at a first timing after the first time elapses from the point of time of step S7. Also, when the humidity is equal to or larger than the first threshold value at the setting of the waiting time (when the charge amount of the toner on the cleaning roller 55 is equal to or smaller than the predetermined value), the collection control starts at a second timing after the second time shorter than the first time elapses from the point of time of step S7.

Thereby, when the charge amount of the toner on the cleaning roller 55 is small, the timing at which the collection control starts is shortened. Therefore, it is possible to suppress the toner of which the charge amount is lowered from being detached from the cleaning roller 55, thereby suppressing a printing defect due to detached toner. Incidentally, when the printing control is being performed at the starting of the collection control, the control device 100 once interrupts the printing control and executes the collection control. Then, after the collection control is finished (specifically, after the control of FIG. 4 is finished), the control device 100 resumes the printing control.

When it is determined in step S12 that the first timer is less than the waiting time (No), the control device 100 determines whether the second timer is equal to or longer than the third time (S13). Here, the second timer is not reset unless the control device 100 receives the printing command until the third time elapses after the previous printing control is finished (S1). Therefore, the control device 100, in fact, determines in step S13 whether the printing command is not received until the third time elapses after the previous printing control is finished.

Here, the third time is set to be slightly shorter than a fourth time after the printing control is finished. Specifically, the third time is set to be shorter than the fourth time by the time that is consumed to perform at least the collection control. Incidentally, in the specification, the sleep mode refers to a mode in which the power feeding to a motor and the like for driving the heating roller 81 and the various rollers is OFF.

When it is determined in step S13 that the second timer is equal to or longer than the third time (Yes), the control device 100 executes the collection control (S15). That is, when the control device 100 does not receive the printing command until the third time elapses after the previous printing control is finished (S13: Yes), the control device 100 starts the collection control even before the first timing or second timing (even when a result of the determination in step S12 is not Yes).

Thereby, since the collection control can be executed before the sleep mode is started, it is possible to suppress the toner from being detached from the cleaning roller 55, which is caused as the charge amount of the toner on the cleaning roller 55 is lowered during the sleep mode.

When it is determined in step S13 that the second timer is less than the third time (No), the control device 100 determines whether a total number of printed sheets after the previous collection control is finished is equal to or larger than a third threshold (S14). That is, the control device 100 is configured to reset the total number of printed sheets to 0 whenever the collection control is finished and to measure the total number of printed sheets from one thereafter.

When it is determined in step S14 that the total number of printed sheets is equal to or larger than the third threshold value (Yes), the control device 100 starts the collection control (S15). That is, when the total number of printed sheets is equal to or larger than the third threshold value, the control device 100 starts the collection control even before the first timing or the second timing (even when a result of the determination in step S12 is not Yes).

Accordingly, when the total number of printed sheets increases and thus the amount of the toner held on the cleaning roller 55 increases, the control device 100 forcibly starts the collection control even before the first timing or the second timing. Therefore, it is possible to suppress the toner from being detached from the cleaning roller 55, which is caused as the amount of the toner on the cleaning roller 55 is excessively increased.

After the collection control (S15) is finished, the control device 100 resets the first timer (S16), resets the waiting time (S17), returns the flag F to 0 (S18) and then finishes this control. Also, when a result of the determination in step S14 is No, the control device 100 finishes this control.

Figure 5:
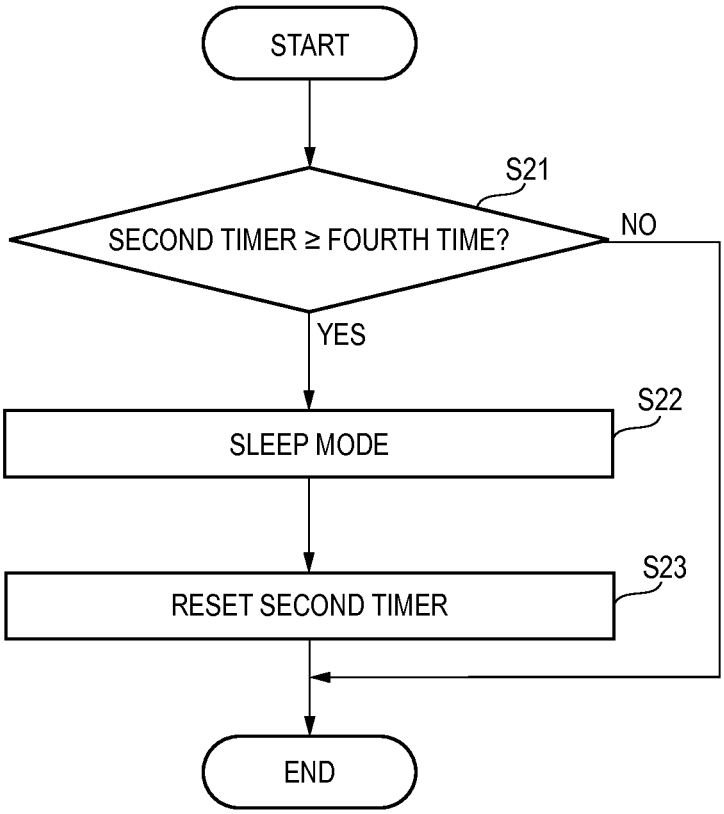
FIG. 5 is a flowchart showing an operation of the control device for executing a sleep mode.

In the control of FIG. 5, the control device 100 first determines whether the second timer is equal to or longer than the fourth time (S21). When it is determined in step S21 that the second timer is equal to or longer than the fourth time (Yes), the control device 100 starts the sleep mode (S22). That is, when the second timer is equal to or longer than the fourth time, since the second timer has been already the third time, the control device 100 executes the sleep mode after always executing the collection control.

After step S22 or when a result of the determination in step S21 is No, the control device 100 resets the second timer and then finishes this control. Incidentally, the sleep mode starting in step S22 is finished when the control device 100 receives the printing command.

According to the illustrative embodiment, following effects can be achieved in addition to the above-described effects.

That is, the time measuring at the first timer starts at the point of time of step S7, i.e., at the point of time before the printing control starts. Thereby, when the first timing or the second timing arrives during the printing control, the collection control is executed. Therefore, it is possible to suppress the large amount of the toner from being gathered on the cleaning roller 55 and being detached therefrom.

After executing the collection control, the control device 100 resets the waiting time (S17) and sets the waiting time in the next printing control based on the humidity (the charge amount of the toner) (S5, S6). Therefore, it is possible to set the appropriate waiting time corresponding to the charge amount of the toner first attached to the cleaning roller 55 at the next printing control.

While the present invention has been shown and described with reference to certain illustrative embodiments thereof, it will be understood by those skilled in the art that various changes in form and details may be made therein without departing from the spirit and scope of the invention as defined by the appended claims.

In the above illustrative embodiment, the waiting time is set based on the humidity. However, the present invention is not limited thereto. For example, the waiting time may be set depending on a deterioration degree of the toner. In other words, in the above illustrative embodiment, the charge amount estimation unit is configured to estimate the charge amount based on the humidity. However, the charge amount estimation unit may be configured to estimate the charge amount based on the deterioration degree of the toner in the developing cartridge 530. In the meantime, the deterioration degree may be estimated by a deterioration degree estimation unit provided in the control device 100.

Figure 6:
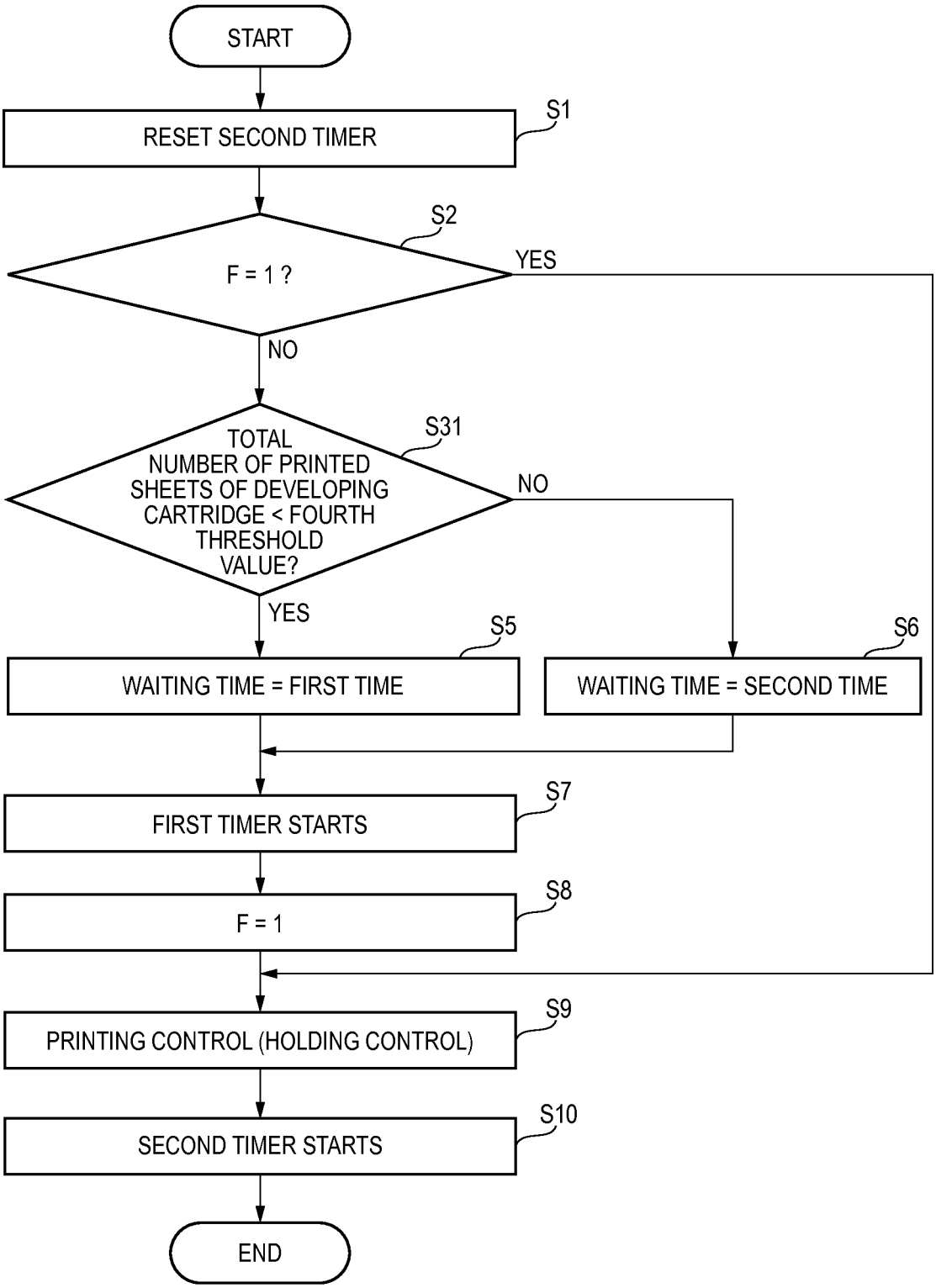
FIG. 6 is a flowchart showing a modified illustrative embodiment in which a condition for setting a waiting time is changed.

For example, as shown in FIG. 6, the deterioration degree estimation unit may be configured to count a total number of printed sheets of the developing cartridge 530, i.e., a total number of sheets P printed up to now by the toner in the developing cartridge 530 after the developing cartridge 530 is mounted to the apparatus main body 2, thereby estimating the deterioration degree of the toner. Incidentally, the total number of printed sheets of the developing cartridge 530 is preferably reset to 0 when the developing cartridge 530 is replaced.

Specifically, in the illustrative embodiment of FIG. 6, a new step S31 is added, instead of steps S3, S4 of FIG. 3. In step S31, the control device 100 determines whether the total number of printed sheets of the developing cartridge 530 is smaller than a fourth threshold value (S31). When it is determined in step S31 that the total number of printed sheets is smaller than the fourth threshold value, i.e., that the deterioration degree of the toner estimated by the deterioration degree estimation unit is less than the second threshold value (Yes), the control device 100 determines that the charge amount estimated by the charge amount estimation unit is larger than the predetermined value, and sets the waiting time to the first time (S5).

Also, when it is determined in step S31 that the total number of printed sheets is equal to or larger than the fourth threshold value, i.e., that the deterioration degree of the toner estimated by the deterioration degree estimation unit is equal to or larger than the second threshold value (No), the control device 100 determines that the charge amount estimated by the charge amount estimation unit is equal to or smaller than the predetermined value, and sets the waiting time to the second time shorter than the first time (S6). Here, when the deterioration degree of the toner is large, the charge amount of the toner on the cleaning roller 55 decreases. As a result, as described above, the timing at which the collection control starts when the deterioration degree of the toner is large is shortened. Therefore, it is possible to suppress the toner of which the charge amount is lowered from being detached from the cleaning roller 55, thereby suppressing a printing defect due to the detached toner.

Incidentally, the parameter indicating the deterioration degree of the toner is not limited to the total number of printed sheets of the developing cartridge 530. For example, a total rotation number of the developing roller and the like may be also used.

In the above illustrative embodiment, the cleaning roller 55 has been exemplified as the holding roller. However, the present invention is not limited thereto. For example, the holding roller may be a brush-shaped member configured to sliding-contact the photosensitive drum and to collect the toner on the photosensitive drum, the charging roller configured to contact the photosensitive drum and to charge the same, and the like.

In the above illustrative embodiment, the cleaning device 10 has been exemplified as the collection device. However, the present invention is not limited thereto. For example, the collection device may be the developing cartridge configured to contact the photosensitive drum and to collect the toner on the photosensitive drum by the developing roller, and a drum cleaning unit having a blade capable of collecting the toner on the photosensitive drum.

In the above illustrative embodiment, the photosensitive drum 51 has been exemplified as the image carrier. However, the present invention is not limited thereto. For example, the image carrier may be a belt-type photosensitive member.

In the above illustrative embodiment, the sheet P such as a cardboard, a postcard, a thin sheet and the like has been exemplified as the sheet. However, the present invention is not limited thereto. For example, the sheet may be an OHP sheet.

In the above illustrative embodiment, the toner having the positive polarity has been exemplified as the developer. However, the present invention is not limited thereto. For example, the developer may be toner having a negative polarity. Incidentally, when the toner having a negative polarity is used, the holding bias, the discharge bias and the like may have an opposite polarity to the illustrative embodiment.

In the above illustrative embodiment, the present invention has been applied to the color printer 1. However, the present invention is not limited thereto. For example, the present invention can be also applied to the other image forming apparatus such as a monochrome printer, a copier, a complex machine and the like.

In the above illustrative embodiment, the developing cartridge 530 has been exemplified as the developing device. However, the present invention is not limited thereto. For example, the developing device may be a process cartridge in which a developing cartridge and a drum cartridge are integrally formed.

What is claimed is:

1. An image forming apparatus comprising:

an image carrier configured to carry thereon a developer image;

a holding roller provided to contact the image carrier and configured to hold thereon developer attached on the image carrier;

a collection device configured to collect the developer on the holding roller via at least the image carrier; and a control device configured to execute a holding control of applying to the holding roller a holding bias having a polarity opposite to the developer such that the holding roller holds developer, a collection control of applying to the holding roller a discharge bias having a polarity same as the developer such that the developer held on the holding roller is moved to the image carrier and the collection device collects the developer via at least the image carrier, and a printing control of transferring a developer image on the image carrier to a sheet, wherein the control device is further configured to:

estimate a charge amount of the developer on the holding roller;

when the estimated charge amount is larger than a predetermined value, start the collection control at a first timing after a first time elapses from a predetermined point of time; and when the estimated charge amount is equal to or smaller than the predetermined value, start the collection control at a second timing after a second time elapses from the predetermined point of time, the second time being shorter than the first time.

2. The image forming apparatus according to claim 1, further comprising:

a humidity detection unit configured to detect humidity, wherein the control device is configured to:

set the estimated charge amount to be larger than the predetermined value when the humidity detected by the humidity detection unit is less than a first threshold value, and set the estimated charge amount to be equal to or smaller than the predetermined value when the humidity detected by the humidity detection unit is equal to or larger than the first threshold value.

3. The image forming apparatus according to claim 1, further comprising:

a developing device configured to accommodate therein developer, wherein the control device is further configured to:

estimate a deterioration degree of the developer in the developing device;

when the estimated deterioration degree is less than a second threshold value, set the estimated charge amount to be larger than the predetermined value; and when the estimated deterioration degree is equal to or larger than the second threshold value, set the estimated charge amount to be equal to or smaller than the predetermined value.

4. The image forming apparatus according to claim 1, wherein when a printing command is not received until a third time elapses after the printing control is finished, the control device is configured to start the collection control even before the first timing or the second timing.

5. The image forming apparatus according to claim 4, wherein when the printing command is not received until the third time elapses after the printing control is finished, the control device is configured to start the collection control even before the first timing or the second timing and execute a sleep mode after the collection control is finished.

6. The image forming apparatus according to claim 1, wherein when a total number of printed sheets after previous collection control is executed is equal to or larger than a third threshold value, the control device is configured to execute the collection control even before the first timing or the second timing.

7. The image forming apparatus according to claim 1, wherein the predetermined point of time is a point of time before the printing control starts.

8. The image forming apparatus according to claim 1, wherein when the collection control is executed, the control device is configured to reset the first time or the second time and set a new first time or a new second time in a next printing control based on the charge amount.

9. An image forming apparatus comprising:

an image carrier configured to carry thereon a developer image;

a holding roller provided to contact the image carrier and configured to hold thereon developer attached on the image carrier;

a collection device configured to collect the developer on the holding roller via at least the image carrier; and a control device configured to execute a holding control of applying to the holding roller a holding bias having a polarity opposite to the developer such that the holding roller holds developer, and a collection control of applying to the holding roller a discharge bias having a polarity same as the developer such that the developer held on the holding roller is moved to the image carrier and the collection device collects the developer via at least the image carrier, wherein the control device is further configured to:

when a humidity is less than a first threshold value, start the collection control at a first timing after a first time elapses from a predetermined point of time; and when the humidity is equal to or larger than the first threshold value, start the collection control at a second timing after a second time elapses from the predetermined point of time, the second time being shorter than the first time.

10. The image forming apparatus according to claim 9, wherein the control device is further configured to execute a printing control of transferring a developer image on the image carrier to a sheet, and wherein when a printing command is not received until a third time elapses after the printing control is finished, the control device is configured to start the collection control even before the first timing or the second timing.

11. The image forming apparatus according to claim 10, wherein when the printing command is not received until the third time elapses after the printing control is finished, the control device is configured to start the collection control even before the first timing or the second timing and execute a sleep mode after the collection control is finished.

12. The image forming apparatus according to claim 9, wherein when a total number of printed sheets after previous collection control is executed is equal to or larger than a third threshold value, the control device is configured to execute the collection control even before the first timing or the second timing.

13. The image forming apparatus according to claim 9, wherein the predetermined point of time is a point of time before a printing control of transferring a developer image on the image carrier to a sheet starts.

14. The image forming apparatus according to claim 9, wherein when the collection control is executed, the control device is configured to reset the first time or the second time and set a new first time or a new second time in a next printing control based on the humidity.

15. An image forming apparatus comprising:

an image carrier configured to carry thereon a developer image;

a developing device configured to accommodate therein developer, a holding roller provided to contact the image carrier and configured to hold thereon developer attached on the image carrier;

a collection device configured to collect the developer on the holding roller via at least the image carrier; and a control device configured to execute a holding control of applying to the holding roller a holding bias having a polarity opposite to the developer such that the holding roller holds developer, and a collection control of applying to the holding roller a discharge bias having a polarity same as the developer such that the developer held on the holding roller is moved to the image carrier and the collection device collects the developer via at least the image carrier, wherein the control device is further configured to:

when a total number of printed sheets of the developing device is less than a fourth threshold value, start the collection control at a first timing after a first time elapses from a predetermined point of time; and when the total number of printed sheets of the developing device is equal to or larger than the fourth threshold value, start the collection control at a second timing after a second time elapses from the predetermined point of time, the second time being shorter than the first time.

16. The image forming apparatus according to claim 15, wherein the control device is further configured to execute a printing control of transferring a developer image on the image carrier to a sheet, and wherein when a printing command is not received until a third time elapses after the printing control is finished, the control device is configured to start the collection control even before the first timing or the second timing.

17. The image forming apparatus according to claim 16, wherein when the printing command is not received until the third time elapses after the printing control is finished, the control device is configured to start the collection control even before the first timing or the second timing and execute a sleep mode after the collection control is finished.

18. The image forming apparatus according to claim 15, wherein when a total number of printed sheets after previous collection control is executed is equal to or larger than a third threshold value, the control device is configured to execute the collection control even before the first timing or the second timing.

19. The image forming apparatus according to claim 15, wherein the predetermined point of time is a point of time before a printing control of transferring a developer image on the image carrier to a sheet starts.

20. The image forming apparatus according to claim 15, wherein when the collection control is executed, the control device is configured to reset the first time or the second time and set a new first time or a new second time in a next printing control based on the total number of printed sheets of the developing device.

* * * * *